US008066122B2

(12) United States Patent
Beecroft et al.

(10) Patent No.: US 8,066,122 B2
(45) Date of Patent: Nov. 29, 2011

(54) CHILD-RESISTANT PACKAGE WITH PIVOTABLE BLISTER CARD

(75) Inventors: W. Gordon Beecroft, Leola, PA (US); Chad E. Rice, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 12/710,124

(22) Filed: Feb. 22, 2010

(65) Prior Publication Data

US 2010/0252478 A1 Oct. 7, 2010

Related U.S. Application Data

(60) Provisional application No. 61/165,771, filed on Apr. 1, 2009.

(51) Int. Cl.

| | |
|---|---|
| ***B65D 43/16*** | (2006.01) |
| ***B65D 85/42*** | (2006.01) |
| ***B65D 83/04*** | (2006.01) |
| ***A45C 13/10*** | (2006.01) |

(52) U.S. Cl. ..... 206/536; 206/1.5; 206/528; 206/538

(58) Field of Classification Search ..... 206/528, 206/531, 534, 536, 539, 530, 1.5, 538; 220/283, 220/824

See application file for complete search history.

(56) References Cited

U.S. PATENT DOCUMENTS

| | | | | |
|---|---|---|---|---|
| 4,192,422 | A | 3/1980 | Kotyuk | |
| 4,932,547 | A | 6/1990 | Rodriguez | |
| 5,878,887 | A | 3/1999 | Parker | |
| 6,173,838 | B1 | 1/2001 | Brozell | |
| 6,302,120 | B1 | 10/2001 | Kuo | |
| 6,318,550 | B1 | 11/2001 | Giovinazzi | |
| 6,349,831 | B1 | 2/2002 | Buss | |
| 6,752,272 | B2 | 6/2004 | Jones et al. | |
| 6,789,677 | B2 | 9/2004 | Maietta | |
| 6,913,149 | B2 | 7/2005 | Gelardi et al. | |
| 6,951,282 | B2 | 10/2005 | Jones | |
| 7,090,079 | B2 | 8/2006 | Ehrlund | |
| 7,093,736 | B2 | 8/2006 | Maietta | |
| 7,150,355 | B2 | 12/2006 | Coe et al. | |
| 7,198,149 | B2 | 4/2007 | Gelardi | |
| 7,434,692 | B2 | 10/2008 | Ginsberg et al. | |
| 7,464,819 | B2 | 12/2008 | Maietta | |
| 7,588,149 | B2 * | 9/2009 | Gelardi | 206/531 |
| 2004/0026293 | A1 | 2/2004 | Hughes | |
| 2006/0006091 | A1 | 1/2006 | Maietta | |
| 2007/0045150 | A1 | 3/2007 | Huffer et al. | |
| 2007/0102318 | A1 | 5/2007 | Gelardi et al. | |
| 2007/0138049 | A1 | 6/2007 | Bitner | |
| 2007/0235368 | A1 | 10/2007 | Knutson et al. | |
| 2007/0261984 | A1 | 11/2007 | Gelardi | |
| 2007/0278124 | A1 | 12/2007 | Saclier et al. | |
| 2008/0251410 | A1 | 10/2008 | Gelardi | |
| 2008/0257773 | A1 | 10/2008 | Gelardi | |
| 2008/0283434 | A1 * | 11/2008 | Gelardi | 206/468 |
| 2009/0045078 | A1 * | 2/2009 | Gelardi et al. | 206/1.5 |
| 2009/0045096 | A1 * | 2/2009 | Knutson et al. | 206/570 |
| 2009/0139894 | A1 * | 6/2009 | Bitner | 206/531 |

* cited by examiner

*Primary Examiner* — J. Gregory Pickett
*Assistant Examiner* — Andrew Perreault
(74) *Attorney, Agent, or Firm* — Barnes & Thornburg LLP

(57) ABSTRACT

A child-resistant package includes a case and blister cards. The blister cards are mounted for movement between stored positions inside the case and exposed positions outside the case.

25 Claims, 8 Drawing Sheets

10
12
14
14S
16
17
18
20
22
24
26
28
29
30
31
32
36
37L
37R
39
40
41
50
51
52
55
56L
58
59
60
64
65
66
80
81
82
83
84
85
94
145
181
182
232
7

CHILD-RESISTANT PACKAGE WITH PIVOTABLE BLISTER CARD

This application claims priority under 35 U.S.C. §119(e) to U.S. Provisional Application Ser. No. 61/165,771, filed Apr. 1, 2009, which is expressly incorporated by reference herein.

BACKGROUND

The present disclosure relates to child-resistant packaging, and particularly to packaging for blister cards. More particularly, the present disclosure relates to containers for storing blister cards.

SUMMARY

A package in accordance with the present disclosure includes a case and a tablet carrier mounted for movement relative to the case. The tablet carrier is configured to carry tablets or other items on a movable sheet.

In illustrative embodiments, the package includes a case and two blister cards mounted for pivotable movement between stored positions inside the case and exposed positions outside the case. Each blister card is movable relative to the case so that one or both of the blister cards can be moved to the exposed positions to gain access to tablets carried in the blister cards. A first of the two blister cards is mounted on a first pivot post included in the case for pivotable movement about a first card pivot axis. A second of the two blister cards is mounted on a separate second pivot post included in the case for pivotable movement about a second card pivot axis.

In illustrative embodiments, the package is child-resistant. The case is a monolithic element and includes a lid and a blister-card container coupled to the lid by a hinge. The package also includes a card-pivot controller coupled to the lid and configured to retain the blister cards in the stored position and to be operated by an adult to release the blister cards so that they are free to be pivoted relative to the case from their stored positions to their exposed positions.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 14 is an enlarged sectional view taken along line 14-14 of FIG. 13;

FIG. 15 is a sectional view taken along line 15-15 of FIG. 14 showing movement of a perimeter edge of the top blister card toward a cam ramp formed on the downwardly extending retention post included in the second card retainer;

FIG. 16 is a sectional view similar to FIG. 14 after further pivoting movement of the top blister card in the clockwise direction;

FIG. 17 is a sectional view taken along line 17-17 of FIG. 16 showing camming engagement of the pivoting perimeter edge of the top blister card and the cam ramp on the retention post to cause upward movement of the retention post;

FIG. 18 is a sectional view similar to FIGS. 14 and 16 after further pivoting movement of the top blister card in the clockwise direction to reach the stored position; and FIG. 19 is a sectional view taken along line 19-19 of FIG. 18 showing return of the retention post of the second card retainer to a position extending through the retention apertures formed in the top and bottom blister cards.

DETAILED DESCRIPTION

Figure 1:
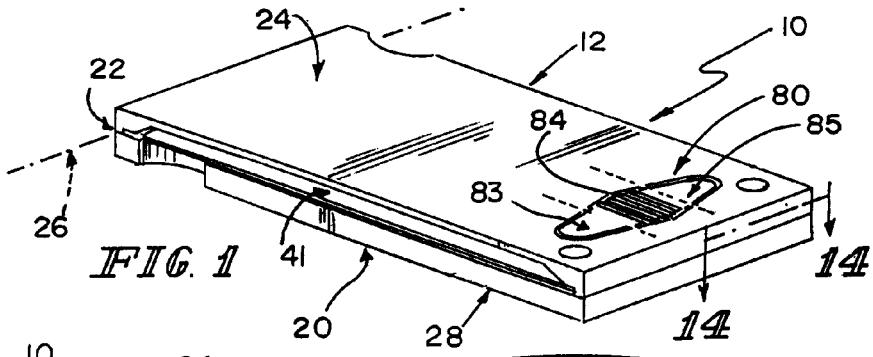
FIG. 1 is a perspective view of a closed blister-card package provided with child-resistant features in accordance with the present disclosure.
Figure 3:
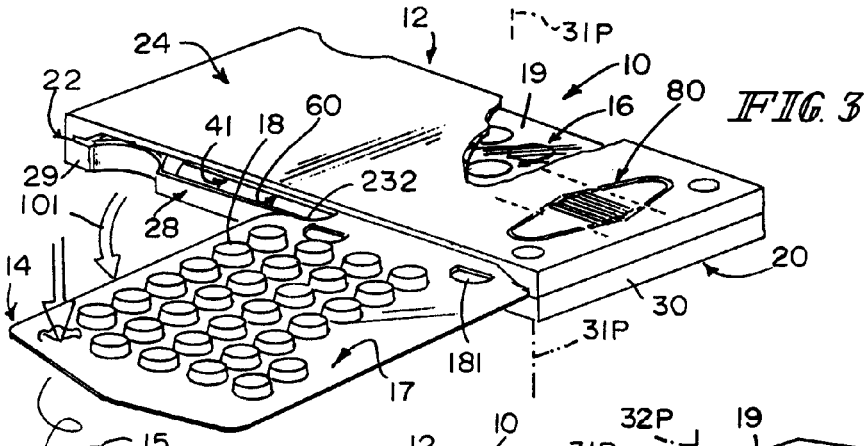
FIG. 3 is a view similar to FIG. 2, with portions broken away, showing that the bottom blister card is retained in a stored position in the interior region formed in the case and that the top blister card has been pivoted in a counterclockwise direction relative to the case to assume an exposed position outside of the interior region formed in the case after manual operation of a card-pivot controller coupled to a lid included in the case in a manner suggested in FIGS. 9-12, and showing removal of a tablet from a tablet-receiving pocket formed in the exposed top blister card.
Figure 3A:
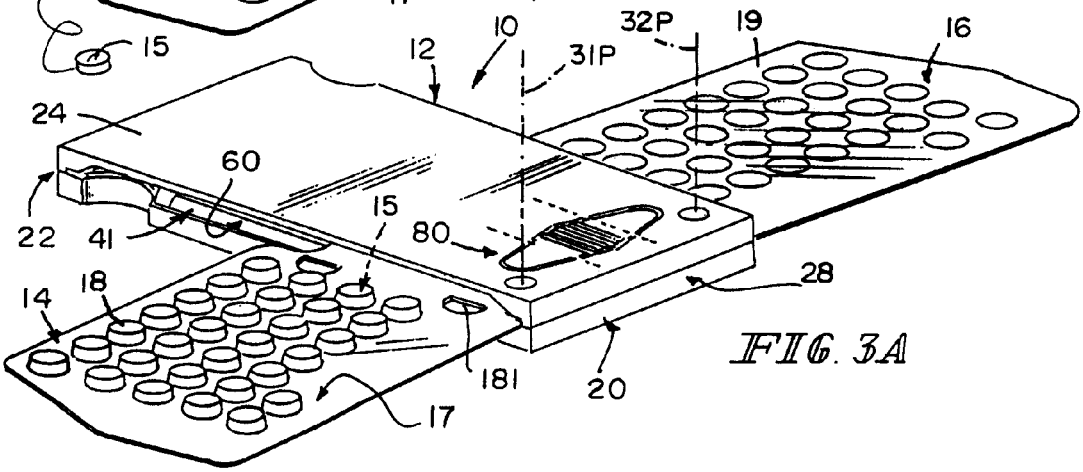
FIG. 3A is a view similar to FIGS. 2 and 3 showing each of the top and bottom blister cards in an exposed position at the same time.
Figure 4:
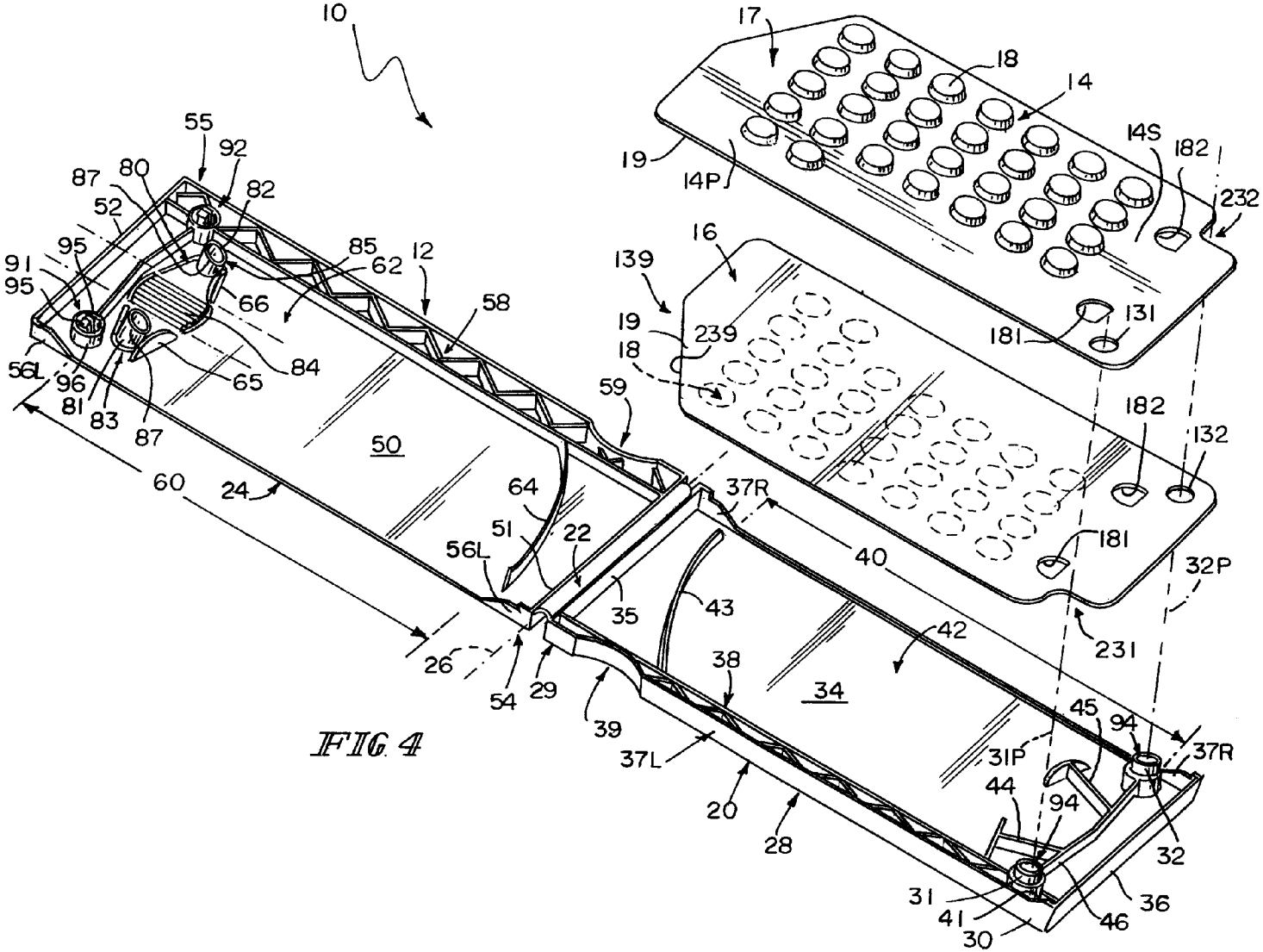
FIG. 4 is an exploded perspective assembly view of the components that cooperate to form the blister-card package of FIGS. 1-3 showing a top blister card, an underlying bottom blister card, and an opened monolithic child-resistant case including a base including a blister-card container, a first pivot post coupled to a left-side portion of the container and adapted to mate with the top blister card, and a second pivot post coupled to a right-side portion of the container and adapted to mate with the bottom blister card, a lid formed to include a somewhat diamond-shaped card-pivot controller, and a living hinge arranged to interconnect the lid and the base and support the lid for pivotable movement relative to the base from an opened position shown in FIG. 4 to a closed position shown in FIG. 1 in a manner shown, for example, in FIGS. 5 and 6, while the first and second blister cards are mounted on their companion pivot posts and arranged to lie on the base.

A child-resistant package 10 includes a blister-card case 12 configured to hold first and second blister cards 14, 16 as suggested in FIGS. 1 and 4. Each blister card 14, 16 is configured to carry a collection of tablets 15 or other similar small capsules, lozenges, or elements as suggested in FIGS. 2 and 3. First blister card 14 is supported for pivotable movement between a stored position inside case 12 as shown, for example, in FIG. 2 and an exposed position outside case 12 as shown, for example, in FIGS. 3 and 3A. Second blister card 16 is also supported for pivotable movement between a stored position inside case 12 as shown, for example, in FIG. 3 and an exposed position outside case 12 as shown, for example, in FIGS. 2 and 3A. An illustrative process for assembling child-resistant package 10 is shown in FIGS. 4-8. Illustrative child-resistant features of child-resistant package 10 are shown in FIGS. 9-19.

As suggested in FIGS. 1-4, blister-card case 12 is configured to hold two blister cards 14, 16. As suggested in FIGS. 4 and 13, when blister card 14 is mounted in case 12, it lies on top and is known herein as top blister card 14 and when blister card 16 is mounted in case 12, it lies on bottom (under top blister card 14) and is known herein as bottom blister card 16.

Each of blister cards 14, 16 includes a transparent shell 17 made of any suitable material and formed to include a series of tablet-receiving pockets 18. Each of blister cards 14, 16 also includes a laminate backing layer 19 coupled to a companion shell 17 to retain a tablet 15 in each of the pockets 18 until needed by a consumer. In an illustrative embodiment, laminate backing layer 19 is made of an aluminum foil. Tablets 15 can be removed from companion pockets 18 in the usual way by pushing a tablet 15 through the frangible laminate backing layer 19 (to punch a tablet-discharge opening in laminate backing layer 19) as suggested in FIGS. 2 and 3. It is within the scope of this disclosure to hold and support other suitable cards in case 12.

In an illustrative embodiment, case 12 is monolithic and thus is formed as a single piece of molded plastics material, in three sections, to include a base 20, a lid 24, and a hinge 22 arranged to interconnect base 20 and lid 24 as shown in FIG. 4. Hinge 22 is configured to support lid 24 for pivotable movement about lid pivot axis 26 relative to base 20 from an opened position shown, for example, in FIG. 4 to a closed position shown, for example, in FIG. 1 in a manner suggested, for example, in FIGS. 5 and 6. Other shapes and geometries of case 12 are within the scope of this disclosure.

Base 20 is formed to include a blister-card container 28 having an inner end 29 coupled to hinge 22 and an outer end 30 arranged to lie in spaced-apart relation to hinge 22 as shown, for example, in FIG. 4. Base 20 also includes a first pivot post 31 coupled to a left-side portion of blister-card container 28 and located near outer end 30 of blister-card container 28. Base 20 further includes, in illustrative embodiments, a second pivot post 32 coupled to a right-side portion of blister-card container 28 and located near outer end 30 of blister-card container 28 and in laterally spaced-apart relation to first pivot post 31. As suggested in FIGS. 4 and 13 and also in FIGS. 1-3A, first (top) blister card 14 is mounted on first pivot post 31 for pivotable movement about a first card pivot axis 31P relative to case 12 and second (bottom) blister card 16 is mounted on second pivot post 32 for pivotable movement about a second card pivot axis 32P relative to case 12.

Figure 13:
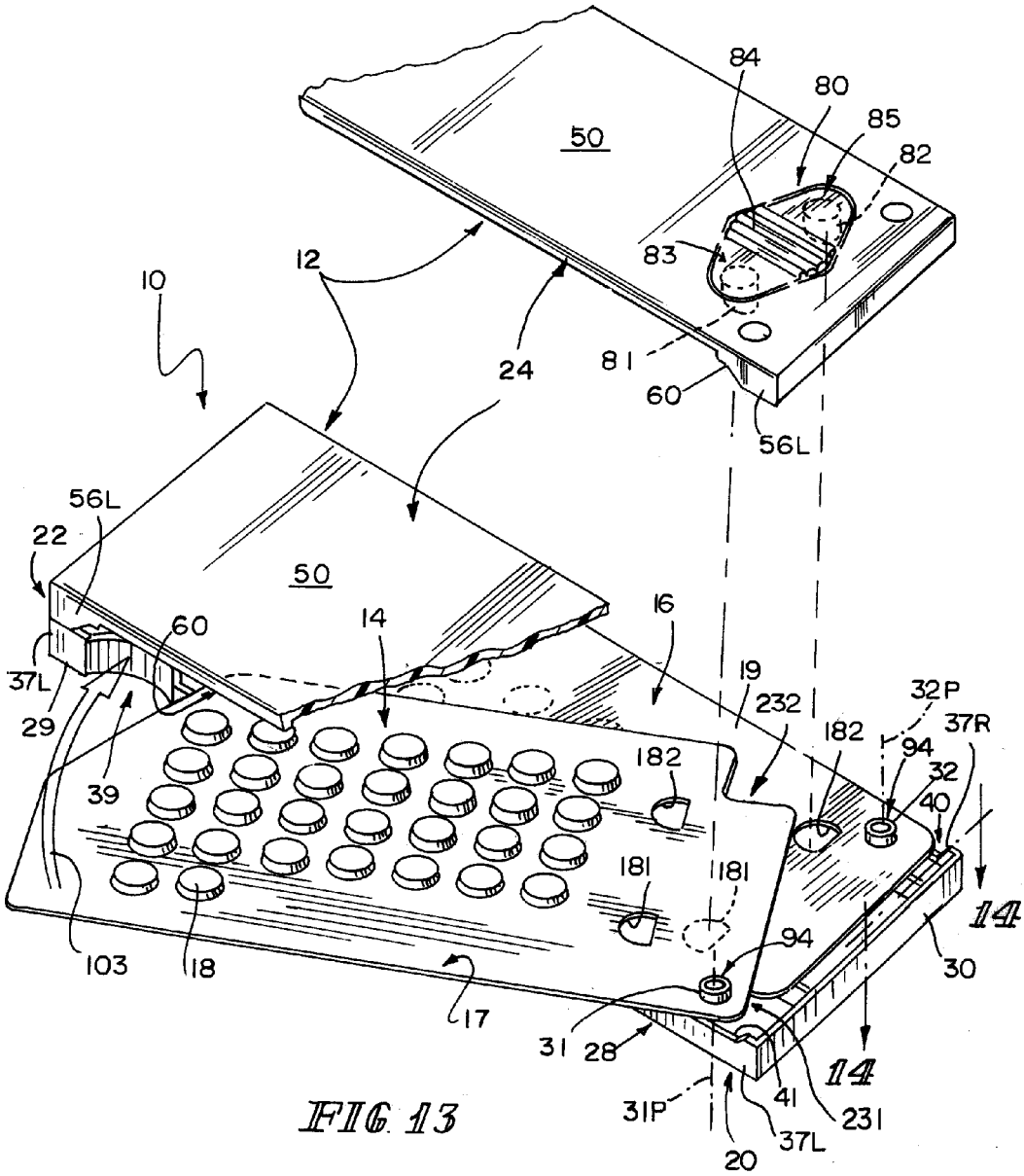
FIG. 13 is a perspective view similar to FIGS. 1-4, with portions separated, showing pivoting movement of the top blister card about the first pivot post in a clockwise direction from the exposed position toward the stored position while the lid is mated with the base and the bottom blister card remains in the stored position.

As suggested in FIGS. 4 and 13, when mounted in blister-card container 28, the dome-shaped tablet-receiving pockets 18 formed in shell 17 of top blister card 14 face upwardly toward lid 24 (when lid 24 is closed) and away from a bottom plate 34 included in blister-card container 28. In an illustrative embodiment, when mounted in blister-card container 28, the dome-shaped tablet-receiving packets 18 formed in shell 17 of bottom blister card 16 face downwardly toward bottom plate 34 of blister-card container 28 and away from lid 24 when lid 24 is closed. As suggested in FIG. 13, laminate back layers 19 of top and bottom blister cards 14, 16 are arranged to face toward one another and lie in closely confronting or touching relation to one another when blister cards 14, 16 are stored in case 12 or moved to exposed positions relative to one another and case 12.

As suggested in FIG. 4, in an illustrative embodiment, blister-card container 28 includes a flat bottom plate 34, an upstanding first end wall 35 coupled to bottom plate 34 at inner end 29 and coupled to hinge 22, an upstanding second end wall 36 coupled to bottom plate 34 at outer end 30 and arranged to locate first and second pivot posts 31, 32 between end walls 35, 36, a right-side wall 37R coupled to a right-side portion of bottom plate 34 and arranged to extend from first end wall 35 to second end wall 36, a left-side wall 37L coupled to a left-side portion of bottom plate 34 and arranged to extend from first end wall 35 to second end wall 36, and a truss structure 38 coupled to left-side wall 37L on a left-side portion of bottom plate 34 and arranged to lie between right-side and left-side walls 37R, 37L and extend from first end wall 35 to second end wall 36. Truss structure 38 includes tension and compression members to strengthen and prevent flexing of bottom plate 34. In an illustrative embodiment, an outwardly opening, recessed cavity 39 is formed in left-side wall 37L and truss structure 38 near inner end 29 to provide access means for exposing a portion 14P of top blister card 14 stored in blister-card container 28 to allow a consumer to grasp top blister card 14 while it remains in a stored position in blister-card container 28 as suggested in FIG. 2.

Figures 5, 6:
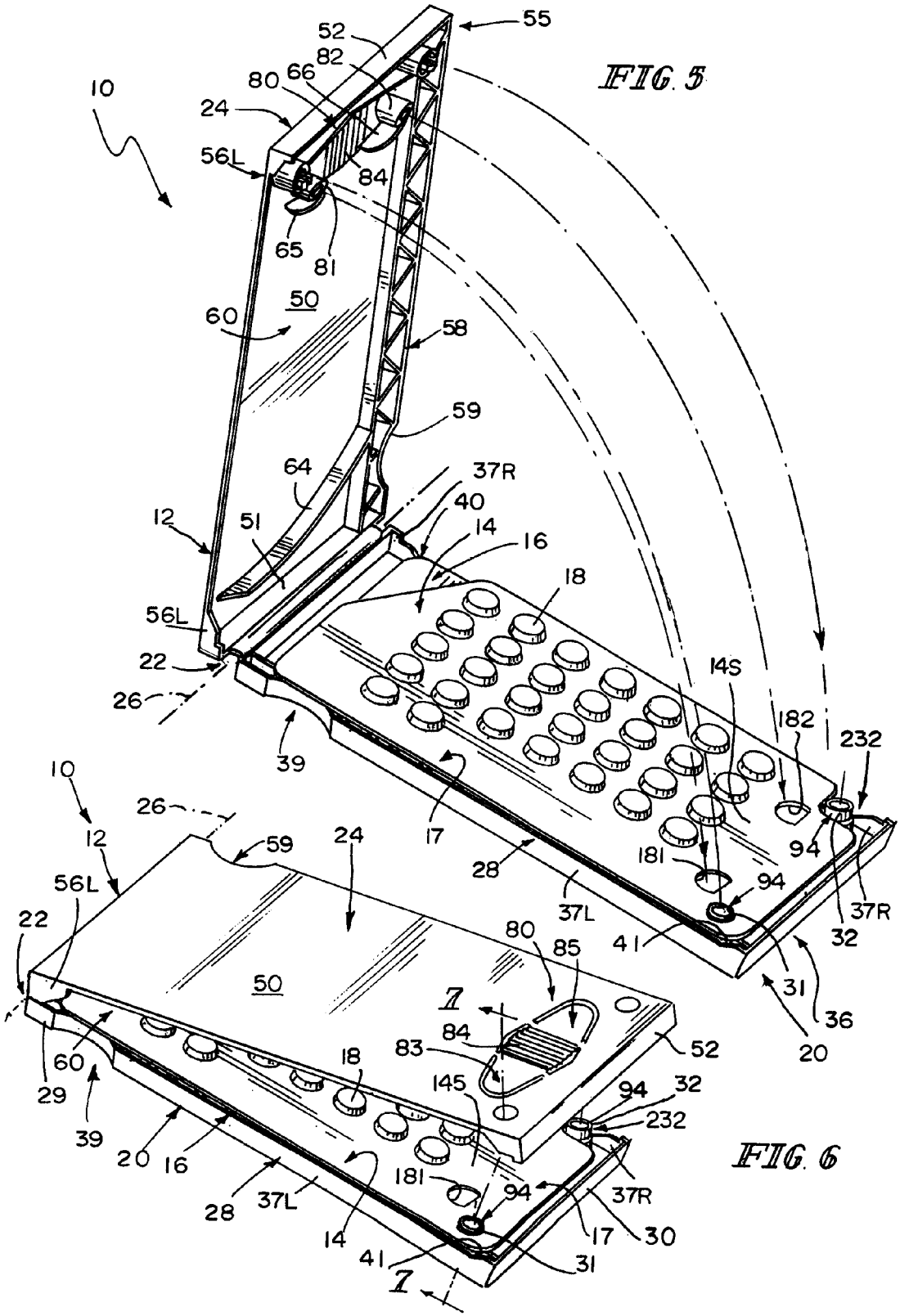
FIG. 5 is a view similar to FIG. 4 after the bottom blister card has been mounted on the second pivot post and the top blister card has been mounted on the first pivot post to overlie the bottom blister card and during pivoting movement of the lid on the hinge toward the closed position.
FIG. 6 is a view similar to FIG. 5 showing the lid just before it mates with the base.

Left-side wall 37L of blister-card container 28 is formed to include an elongated opening 41 extending along almost the entire length of truss structure 38 as suggested in FIGS. 4-6. This opening 41 is sized to allow movement of a portion of top blister card 14 therethrough during movement of top blister card 14 relative to case 12 between the stored and exposed positions as suggested in FIGS. 2, 3, and 3A.

Figure 2:
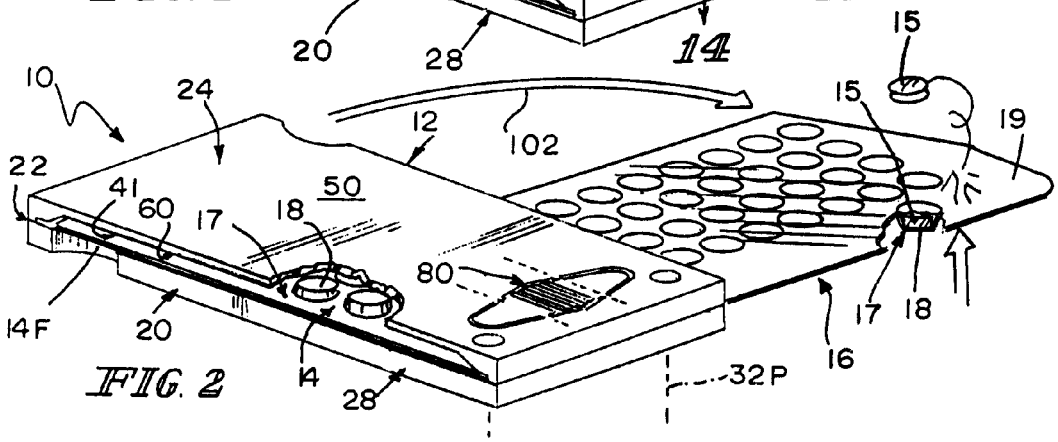
FIG. 2 is a perspective view of the package of FIG. 1, with portions broken away, showing that the package includes a case, a top blister card retained in a stored position in an interior region formed in the case, and a bottom blister card pivoted in a clockwise direction relative to the case to assume an exposed position outside of the interior region formed in the case, and showing removal of a tablet from a tablet-receiving pocket formed in the exposed bottom blister card.

Right-side wall 37R of blister-card container 28 is formed to include an elongated opening 40 extending along almost the entire length of right-side wall 37R as suggested in FIG. 4 to provide aperture means for exposing an edge portion of a blister card (e.g., bottom blister card 16) stored in blister-card container 28 to allow a consumer to move bottom blister card 16 therethrough from the stored position in blister-card container 28 to the exposed position outside blister-card container 28 as suggested in FIG. 13 and FIGS. 2 and 3. Opening 40 in right-side wall 37R is sized to allow the downwardly extending tablet-receiving pockets 18 formed in shell 17 of bottom blister card 16 to pass freely out of an interior region 42 overlying bottom plate 34 through opening 40 as bottom blister card 16 is pivoted on second pivot post 32 about second card pivot axis 32P in clockwise direction 102 from the storage position shown in FIG. 3 to the exposed position shown in FIG. 2.

An interior region 42 formed in blister-card container 28 above plate 34 is bounded by walls 35, 36, 37R and 37L as suggested in FIG. 4. Blister-card container 28 also includes upstanding card supports 43, 44, 45, 46 coupled to bottom plate 34 and located in interior region 42. A first card support 43 is located near first end wall 35 and between recessed cavity 39 and an inner portion of right-side wall 37R. First card support 43 is curved and has a convex surface facing toward first end wall 35 and a concave surface facing toward pivot posts 31, 32 and second end wall 36. Second and third card supports 44, 45 are coupled to bottom plate 34, located in interior region 42 and arranged to extend in diverging relation to one another in an inner direction facing toward first end wall 35. Fourth card support 46 is coupled to outer ends of second and third card supports 44, 45 and arranged to interconnect first and second pivot posts 31, 32. Card supports 43, 44, 45, 46 cooperate to contact shell 17 of bottom blister card 16 and provide means for supporting bottom blister card 16 in spaced-apart relation to underlying bottom plate 34 during pivoting movement of bottom blister card 16 about second card pivot axis 32P relative to bottom plate 34.

As suggested in FIG. 4, lid 24 includes a flat top plate 50, an upstanding first end wall 51 coupled to top plate 50 at an inner end 54 of lid 24 and coupled to hinge 22, an upstanding second end wall 52 coupled to top plate 50 at an outer end 55 of lid 24, a left-side wall 56L coupled to a left-side portion of top plate 50 and arranged to extend from first end wall 51 to second end wall 52, a right-side wall 56R coupled to a right-side portion of top plate 50 and arranged to extend from first end wall 51 to second end wall 52, and a truss structure 58 coupled to right-side wall 56R on a right-side portion of top plate 50 and arranged to lie between right-side and left-side walls 56R, 56L and extend from first-end wall 51 to second end wall 52. Truss structure 58 includes tension and compression members to strengthen and prevent flexing of top plate 50. In an illustrative embodiment, an outwardly opening, recessed cavity 59 is formed in right-side wall 56R and truss structure 58 near inner end 54 to provide access means for exposing a portion of bottom blister card 16 stored in blister-card container 28 to allow a consumer to grasp bottom blister card 16 while it remains in a stored position in blister-card container 28.

Left-side wall 56L of lid 24 is formed to include an elongated opening 60 extending almost the entire length of left-side wall 56L as suggested in FIG. 4 to provide aperture means for exposing an edge portion of a blister card (e.g., top blister card 14) stored in blister-card container 28 to allow a consumer to move top blister card 14 therethrough from the stored position in blister-card container 28. Opening 60 in left-side wall 56L is sized to allow tablet-receiving pockets 18 formed in shell 17 of top blister card 14 to pass freely out of an interior region underlying top plate 50 through opening 60 as top blister card 14 is pivoted on first pivot post 31 about first card pivot axis 31P in clockwise direction 101 from the storage position shown in FIG. 2 to the exposed position shown in FIG. 3.

An interior region 62 formed in lid 24 below top plate 50 is bounded by walls 51, 52, 56L and 56R as suggested in FIG. 4. Lid 24 also includes a depending card supports 64, 65, 66 coupled to top plate 50 and located in interior region 62. A first card support 64 is located near first end wall 51 and between recessed cavity 59 and an inner portion of left-side wall 56L. Card support 64 is curved and includes a convex surface facing toward first end wall 51 and a concave surface facing toward second end wall 52. Second and third card supports 65, 66 are coupled to top plate 50 and located in laterally spaced-apart relation to one another near outer end 55 as shown, for example, in FIGS. 4 and 5. Card supports 64, 65, 66 cooperate to provide means for supporting top blister card 14 in spaced-apart relation to overlying top plate 50 during movement of top blister card 14 relative to top plate 50, for example, if case 12 was inverted to cause lid 24 to lie below blister-card container 28.

A card-pivot controller 80 is coupled to top plate 50 of in lid 24 of child-resistant case 12 and configured to provide a child-resistant means for retaining top and bottom blister cards 14, 16 normally in stored positions in case 12 as shown, for example, in FIG. 4. Card-pivot controller 80 includes a first retention post 81 and a second retention post 82. Each of first and second retention posts 81, 82 is configured to engage and retain each of top and bottom blister cards 14, 16 while those cards 14, 16 lie in their stored positions in case 12, to retain those cards 14, 16 normally in those stored positions as suggested in FIGS. 5, 10, 12, and 13. A user can operate card-pivot controller 80 in an illustrative manner shown in FIGS. 9-12 to disengage and release top and bottom blister cards 14, 16 to free each of cards 14, 16 to be moved from stored positions shown in FIG. 1 to exposed positions shown in FIGS. 2-3A.

Hinge 22 is configured to interconnect edges of first end walls 35 of blister-card container 28 and first end wall 51 of lid 24 as shown, for example, in FIG. 4. Hinge 22 is a living hinge in the illustrated embodiment and is arranged to extend nearly the width of plates 34 and 50. It is within the scope of this disclosure to use other suitable hinges.

Top blister card 14 is formed to include a first pivot aperture 131 and first and second retention apertures 181, 182 as suggested in FIG. 4. As suggested in FIGS. 4-6 and 13, first pivot post 31 of case 12 is arranged to extend upwardly through first pivot aperture 131 to support top blister card 14 for pivotable movement about first card pivot axis 31P relative to case 12 from the stored position shown in FIGS. 1 and 2 to the exposed position shown in FIGS. 3, 3A, and 13. Each of first and second retention apertures 181, 182 is sized to receive therein one of retention posts 81, 82 included in card-pivot controller 80 when top blister card 14 is positioned to lie in the stored position in child-resistant case 12 as suggested in FIGS. 8, 10, and 13 so that top blister card 14 is retained in the stored position in case 12 until an adult operates card-pivot controller 80 in an illustrative manner described herein and shown in FIGS. 9-12 to release top blister card 14 to free it for pivoting movement toward the exposed position.

Top blister card 14 also is formed to include a second-post notch 232 in a lower right-side corner thereof as shown in FIG. 4. Second-post notch 232 is sized to provide clearance to receive second pivot post 32 therein when top blister card 14 assumes the stored position as suggested, for example, in FIGS. 5, 6, and 18. Top blister card 14 also includes a cutaway section 159 in an upper right-side corner thereof as shown in FIG. 4. Cutaway section 159 is configured to cause an edge 259 thereof to lie in spaced-apart relation to recessed cavity 59 formed in lid 24 so that a portion of top blister card 14 is exposed in recessed cavity 59 and can be grasped by a consumer while top blister card 14 lies in the stored position in case 12.

Bottom blister card 16 is formed to include a second pivot aperture 132 and first and second retention apertures 181, 182 as suggested in FIG. 4. As suggested in FIGS. 4-6 and 13, second pivot post 32 of case 12 is arranged to extend upwardly through second pivot aperture 132 to support bottom blister card 16 for pivotable movement about second card pivot axis 32P relative to case 12 from the stored position shown in FIGS. 1, 3, and 13 to the exposed position shown in FIGS. 2 and 3A. Each of first and second retention apertures 181, 182 is sized to receive one of retention posts 81, 82 included in card-pivot controller 80 when bottom blister card 16 is positioned to lie in the stored position in child-resistant case 12 until an adult operates card-pivot controller 80 in an illustrative manner described herein and shown in FIGS. 9-12 to release bottom blister card 16 to free it for pivoting movement toward the exposed position.

Bottom blister card 16 also is formed to include a first-post notch 231 in a lower left-side corner thereof as shown in FIG. 4. First-post notch 231 is sized to provide clearance to receive first pivot post 31 therein when bottom blister card 16 assumes the stored position as shown, for example, in FIG. 13. Bottom blister card 16 also includes a cutaway section 139 in an upper left-side corner thereof as shown in FIG. 4. Cutaway section 139 is configured to cause an edge 239 thereof to lie in spaced-apart relation to recessed cavity 39 so that portion 14P of bottom blister card 16 is exposed as shown, for example, in FIG. 2 and can be grasped by a consumer while bottom blister card 16 lies in the stored position in case 12.

Figure 7:
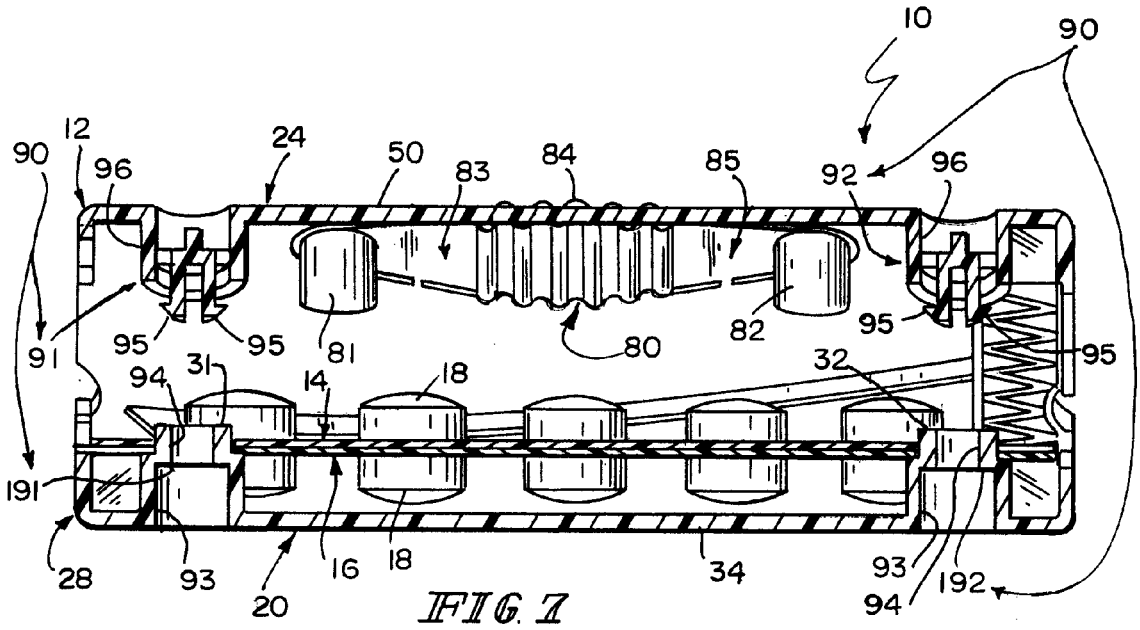
FIG. 7 is an enlarged sectional view taken along line 7-7 of FIG. 6 showing the top and bottom blister cards mounted on companion pivot posts and supported on the base and showing a downwardly extending first lid retainer coupled to the underside of the lid and arranged to lie above and in confronting relation to the first pivot post located on the left side of the base and a downwardly extending second lid retainer also coupled to the underside of the lid and arranged to lie above and in confronting relation to the second pivot post located on the right side of the base.
Figure 8:
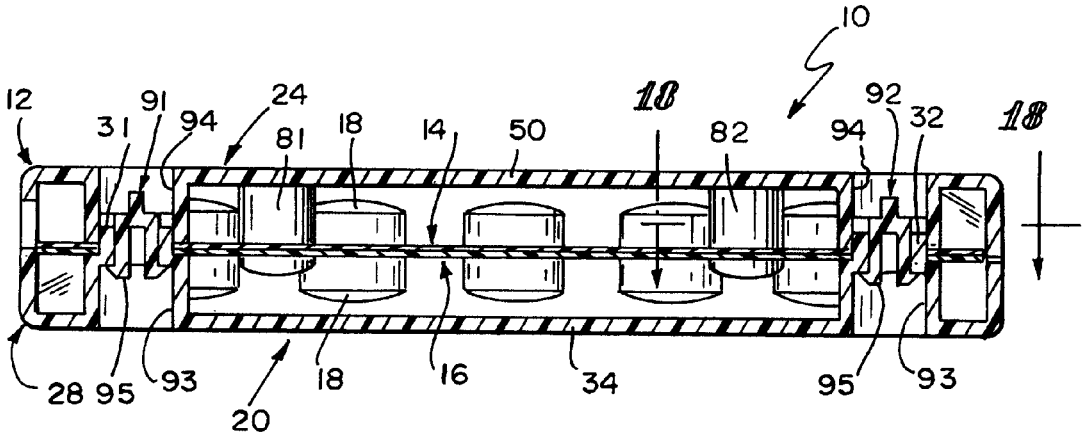
FIG. 8 is a sectional view taken along line 8-8 of FIG. 1 showing mating engagement of the first lid retainer and first pivot post and of the second lid retainer and second pivot post to retain the lid in the closed position on the base while the top and bottom blister cards remain in their stored positions.

Lid-fastener means 90 is provided as shown, for example, in FIGS. 6 and 7, for retaining lid 24 in the closed position on base 20 to establish an interior region 11 of child-resistant case 12 in which blister cards 14, 16 are stored when they assume their stored positions as suggested in FIGS. 1 and 8. Lid-fastener means 90 is configured to hold lid 24 in a fixed position relative to underlying base 20 without disrupting or blocking pivoting movement of either one of blister cards 14, 16 relative to lid 24 and base 20 between their stored and exposed positions.

Lid-fastener means 90 includes a first lid retainer 91 coupled to top plate 50 and a companion retainer anchor 191 coupled to first pivot post 31 and arranged to mate with first lid retainer 91 as shown, for example, in FIG. 8 to retain lid 24 in the closed position on base 20. In illustrative embodiments, lid fastener means 90 also includes a second lid retainer 92 coupled to top plate 50 and a companion retainer anchor 192 coupled to second pivot post 32 and arranged to mate with second lid retainer 92 as shown, for example, in FIG. 8 to retain lid 24 in the closed position on base 20.

First pivot post 31 is formed to include a wide-diameter finger-receiver chamber 93 and a narrow-diameter finger-transfer channel 94 having a top aperture opening into interior region 11 and a bottom aperture opening into wide-diameter finger-receiver chamber 93 as shown, for example, in FIG. 7. In an illustrative embodiment, retainer anchor 191 is an annular wall surrounding that bottom aperture and lying at a boundary between finger-transfer channel 94 and finger-receiver chamber 93 as shown in FIG. 7.

First lid retainer 91 includes several fingers 95 and a finger carrier 96 coupled to top plate 50 of lid 24 and arranged to present fingers 95 toward first pivot post 31 as lid 24 is moved toward base 20 as shown in FIGS. 5-8. Fingers 95 are arranged to pass through finger-transfer channel 94, extend into finger-receiver chamber 93, and mate with retainer anchor 191 as suggested in FIG. 8 to block separation of lid 24 and base 20.

As suggested in FIGS. 6-8, second pivot post 32 is also formed to include a finger-receiver chamber 93 and a finger-transfer channel 94 and a retainer anchor 192 at a boundary between chamber 93 and channel 94. Second lid retainer 92 includes several fingers 95 and a finger carrier 96. Fingers 95 of second lid retainer 92 mate with retainer anchor 192 as shown in FIG. 8 to help block separation of lid 24 and base 20.

Card-pivot controller 80 is a child-resistant feature included in package 10 and configured normally to block movement of blister cards 14, 16 from the stored positions to the exposed positions. An adult aware of the function of card-pivot controller 80 can operate card-pivot controller 80 easily as suggested in FIGS. 9-12 to free blister cards 14, 16 so that blister cards 14, 16 can be moved from their stored positions shown in FIG. 1 to exposed positions shown in FIGS. 2, 3, and 3A to allow the adult to gain access to tablets 15 stored in blister cards 14, 16.

Figure 9:
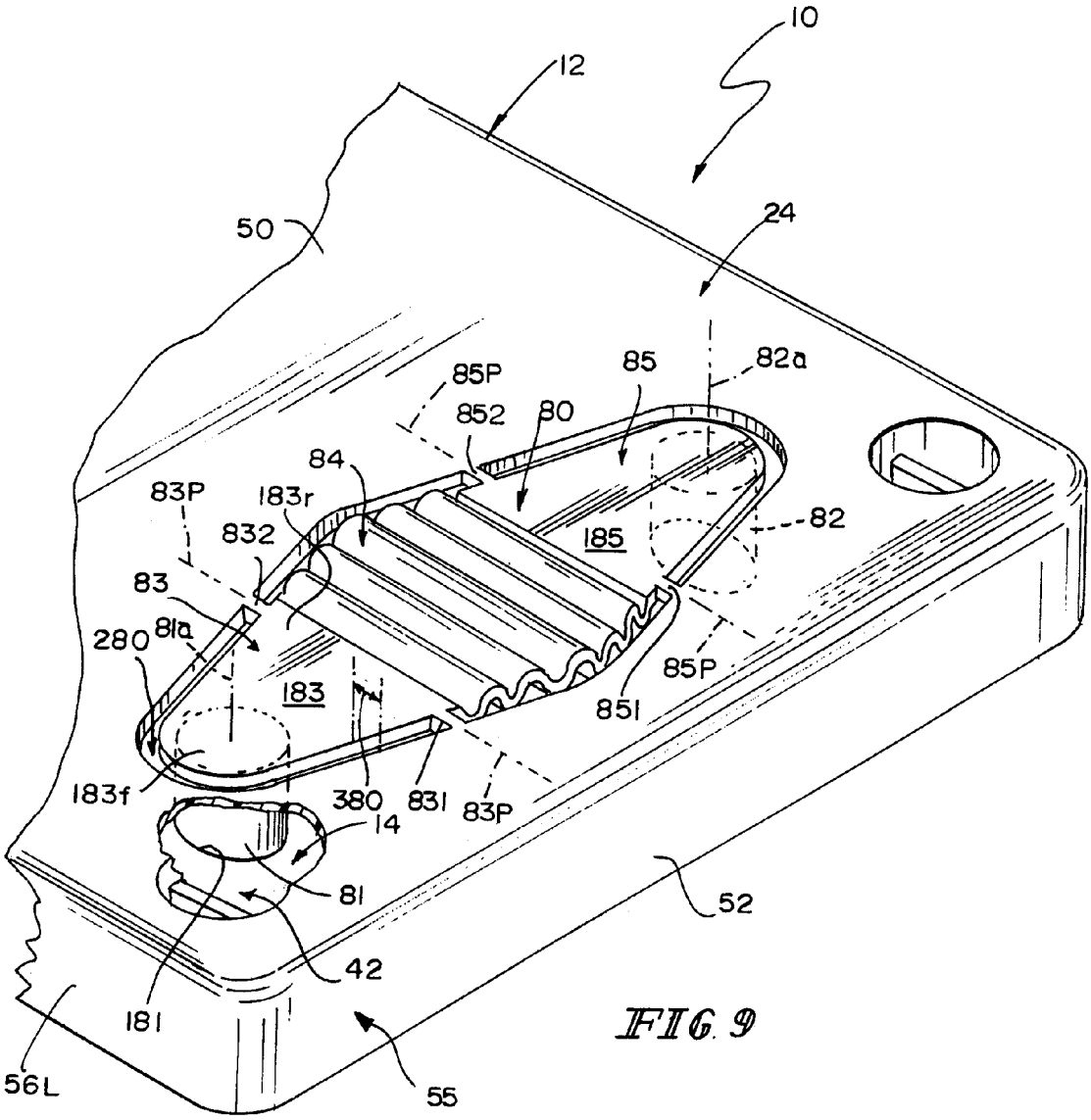
FIG. 9 is an enlarged view of a front portion of the blister-card package of FIG. 1, with portions broken away, showing a somewhat diamond-shaped card-pivot controller coupled to the lid and showing that the card-pivot controller includes a first card retainer coupled to a left side of the lid to pivot about a first retainer pivot axis, a second card retainer coupled to a right side of the lid to pivot about a second retainer pivot axis, and a corrugated retainer mover arranged to interconnect the first and second card retainers and lie between the first and second retainer pivot axes.

In an illustrative embodiment, card-pivot controller 80 is a monolithic element comprising, in series, a pivotable first card retainer 83, a corrugated retainer mover 84, and a pivotable second card retainer 85 as shown, for example, in FIG. 9. First card retainer 83 includes first retention post 81 and second card retainer 85 includes second retention post 82 as shown, for example, in FIGS. 9 and 10.

In use, card-pivot controller 80 is configured to cause first retention post 81 normally to extend through retention apertures 181 formed in blister cards 14, 16 and to cause second retention post 82 normally to extend the retention apertures 182 formed in blister cards 14, 16 when blister cards 14, 16 lie in their stored positions in case 12 to retain blister cards 14, 16 in those stored positions as shown, for example, in FIGS. 1, 10, 18, and 19. When operated by a knowing adult, as suggested in FIG. 11, downward movement of corrugated retainer mover 84 (when pushed by a finger F) in a direction toward bottom plate 34 in base 20 of case 12 causes upward pivoting movement of first retention post 81 to disengage retention apertures 181 formed in blister cards 14, 16 and upward pivoting movement of second retention post 82 to disengage retention apertures 182 formed in blister cards 14, 16 so that each of blister cards 14, 16 is free to be pivoted by the knowing adult relative to child-resistant case 12 from the stored position to the exposed position.

First card retainer 83 includes a somewhat trapezoidal first retainer plate 183 having a wide end coupled to a left-side end of corrugated retainer mover 84 and a narrow end coupled to first retention post 81 as shown, for example, in FIG. 9. First card retainer 83 also includes a first axle 831 appended to first retainer plate 183 and coupled to top plate 50 of lid 24 and a second axle 832 also appended to first retainer plate 183 and coupled to top plate 50 of lid 24 as shown in FIG. 9 to support plate 183 for pivotable movement about a first retainer pivot axis 83P in a clockwise direction CW in response to movement of corrugated retainer mover 84 relative to and toward top plate 50 as shown, for example, in FIG. 11. Such clockwise pivoting movement causes withdrawal of first retention post 81 from retention apertures 181 formed in blister cards 14, 16.

Second card retainer 85 includes a somewhat trapezoidal second retainer plate 185 having a wide end coupled to a right-side end of corrugated retainer mover 84 and a narrow end coupled to second retention post 82 as shown, for example, in FIG. 9. Second card retainer 85 also includes a first axle 851 appended to second retainer plate 185 and coupled to top plate 50 and a second axle 852 also appended to second retainer plate 185 and coupled to top plate 50 as shown in FIG. 9 to support second retainer plate 185 for pivotable movement about a second retainer pivot axis 85P in counterclockwise direction CCW in response to movement of corrugated retainer mover 84 relative to and toward top plate 50 as shown, for example, in FIG. 11. Such counterclockwise pivoting movement causes withdrawal of second retention post 82 from retention aperture 182 formed in blister cards 14, 16.

As suggested in FIG. 13, top blister card 14 is being pivoted in clockwise direction 103 on first pivot post 31 about first card pivot axis 31P from the exposed position toward a stored position inside case 12. As suggested in an illustrative sequence shown in FIGS. 14-19, each of retention posts 81, 82 are moved to extend downwardly into retention apertures 181, 182 formed in blister cards 14, 16 whenever a blister card 14 or 16 is returned to its stored position inside case 12. This reestablishes the dominion of card-pivot controller 80 over blister cards 14, 16 to cause those blister cards 14, 16 to remain in their stored positions until later released by proper operation of card-pivot controller 80.

Figure 14:
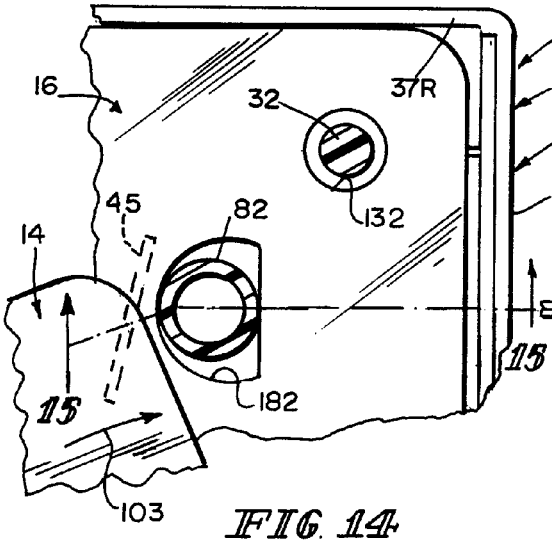
FIGS. 14-19 show a sequence wherein the retention post in the second card retainer is cammed upwardly by the returning top blister card and then forced downwardly into the companion retention aperture formed in the top and bottom blister cards when the top blister card is pivoted to assume its stored position in the case.
Figure 15:
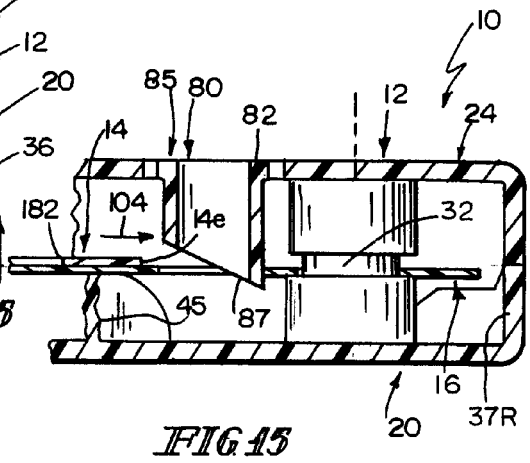
Figure 16:
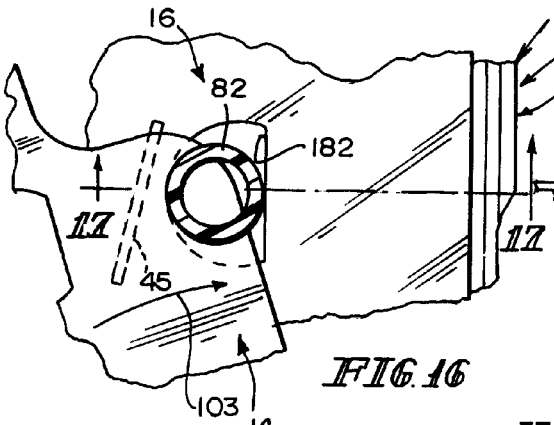
Figure 17:
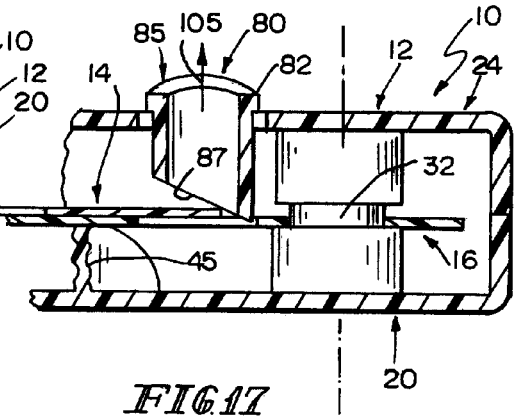

As suggested in FIGS. 14 and 15, a perimeter edge 14*e* of top blister card 14 is moving in direction 104 toward a cam ramp 87 formed on a lower end of retention post 82 included in second card retainer 85 of card pivot controller 80 during pivoting movement of top blister card 14 in clockwise direction 103 about first card pivot axis 31P. After further pivoting movement of top blister card 14 in clockwise direction 103 as suggested in FIGS. 16 and 17, perimeter edge 14*e* of top blister card 14 engages cam ramp 87 on retention post 82 to cause upward movement of retention post 82 in direction 105 to allow continued movement of top blister card 14 toward its stored position in case 12.

Figure 18:
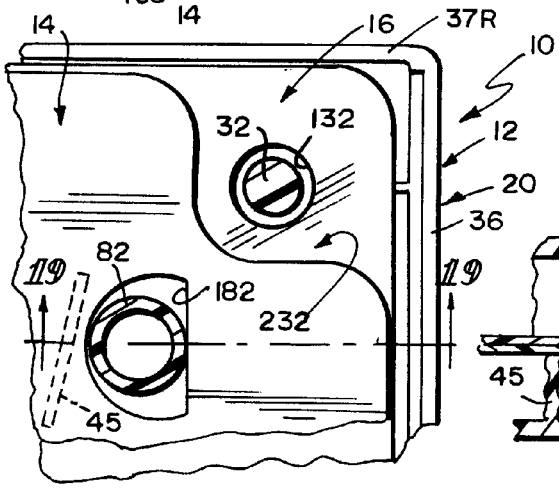
Figure 19:
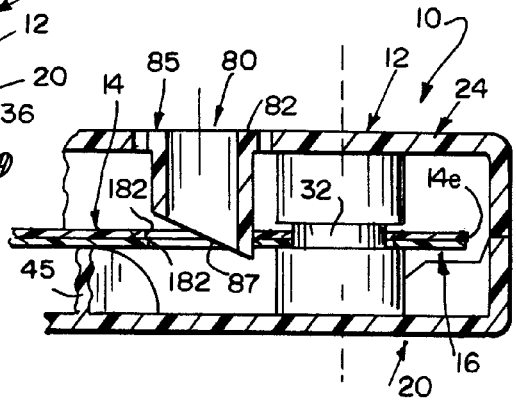

As suggested in FIGS. 18 and 19, top blister card 14 has been pivoted to reach its stored position in case 12. Owing to elasticity of card-pivot controller 80, and illustratively, retainer mover 84, (1) second retention post 82 is urged downwardly in direction 106 to extend into retention apertures 182 formed in blister cards 14, 16 as shown in FIG. 19 and (2) first retention post 81 is also urged downwardly to extend into retention apertures 181 formed in blister cards 14, 16 once those retention apertures 181 are aligned with one another and with first retention post 81 upon arrival of top blister card 14 at the stored position in case 12. Pivot-card controller 180 has now functioned to engage blister cards 14, 16 and retain those cards 14, 16 in their stored positions in case 12.

A child-resistant package 10 includes case 12, first blister card 14, and card-pivot controller 80 as suggested in FIGS. 1-3. Case 12 and card-pivot controller 80 are made of a plastics material and cooperate to form a monolithic element as suggested in FIG. 4. Blister card 14 is configured to be mounted in case 12 as suggested in FIG. 4 and moved relative to case 12 as suggested in FIGS. 2 and 3 when not retained in case 12 by card-pivot controller 80.

Case 12 includes a base 20, a lid 24, a hinge 22 coupled to base and lid 24 to support lid 24 for movement relative to base 20 from a closed position on base 20 to an opened position away from base 20. Case 12 also includes a first pivot post 31 coupled to base 20 as suggested in FIG. 4 and arranged to lie under lid 24 upon movement of lid 24 to the closed position as suggested in FIGS. 6-8.

First blister card 14 is supported on first pivot post 31 for pivotable movement about a first card pivot axis 31P between a stored position inside interior region 42 formed between lid 24 and base 20 upon movement of lid 24 to the closed position and an exposed position extending outside of interior region 42 while lid 24 remains in the closed position as suggested in FIGS. 2 and 3. First blister card 14 is formed to include a first retention aperture 81 as suggested in FIGS. 3 and 4.

Figure 10:
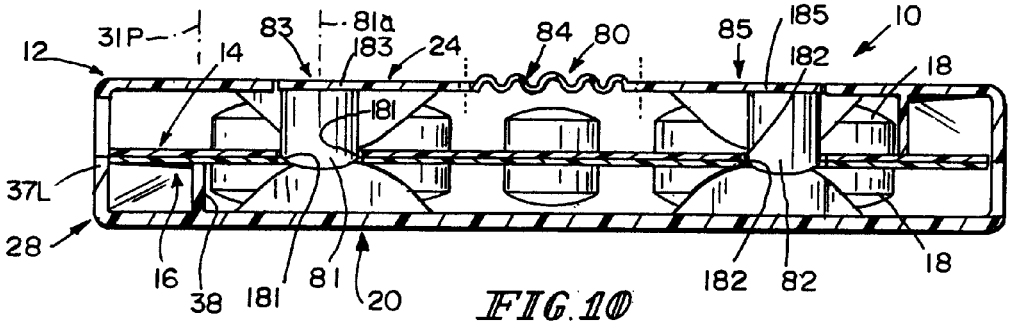
FIG. 10 is a sectional view taken along line 10-10 of FIG. 9 showing that a downwardly extending first retention post included in the first card retainer is arranged to pass through left-side retention apertures formed in each of the top and bottom blister cards (as shown in FIG. 4) so as to retain both blister cards in their stored positions and that a downwardly extending second retention post included in the second card retainer is arranged to pass through right-side retention apertures formed in each of the top and bottom blister cards (as also shown in FIG. 4) so as to assist in retaining both blister cards in their stored positions.
Figure 11:
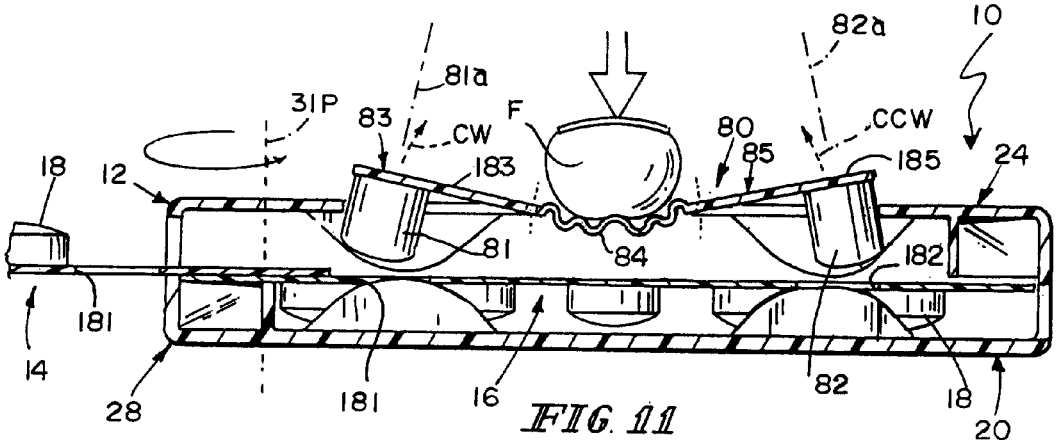
FIG. 11 is a sectional view similar to FIG. 10 showing a user applying a downward force to the corrugated retainer mover of the card-pivot controller to cause downward movement of the corrugated retainer mover and thus cause upward pivotable movement of each of the first and second card retainers to retract the retention posts from the retention apertures formed in the blister cards to free the blister cards for pivotable movement relative to the case and showing that the freed top blister card has been pivoted in a counterclockwise direction about the first pivot post to assume the exposed position.
Figure 12:
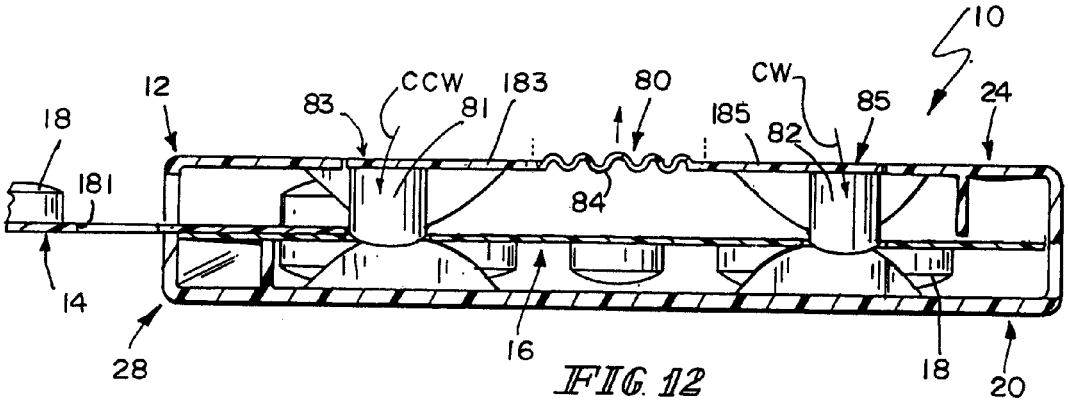
FIG. 12 is a sectional view similar to FIGS. 10 and 11 showing that the card-pivot controller moves automatically from the card-freeing position shown in FIG. 11 to assume the card-retaining position shown in FIG. 10 as soon as the user releases the corrugated retainer mover included in the card-pivot controller.

Card-pivot controller 80 is mounted on lid 24 for movement relative to lid 24 and to first blister card 14 as suggested in FIGS. 10-12. Card-pivot controller 80 is configured to include a first card retainer 83 arranged normally to extend into first retention aperture 81 formed in first blister card 14 while first blister card 14 lies in the stored position in interior region 42 of case 12 to block pivoting movement of first blister card 14 about first card pivot axis 31P toward the exposed position as suggested in FIGS. 9 and 10. Card-pivot controller 80 also includes a retainer mover 84 coupled to first card retainer 83 and supported for movement relative to lid 24 as suggested in FIGS. 10-12. Retainer mover 84 is configured to provide means for moving first card retainer 83 relative to lid 24 to withdraw first card retainer 83 from first retention aperture 181 formed in first blister card 14 to free first blister card 14 to pivot about first card pivot axis 318 and move toward the exposed position while lid 24 remains in the closed position.

First card retainer 83 includes a first retention post 81 sized to move into and out of first retention aperture 181 formed in first blister card 14 while first blister card 14 remains in the stored position as suggested in FIGS. 9-11. First card retainer 83 includes a first retainer plate 183 and axle means 831, 832 as suggested in FIG. 9. First retainer plate 183 is coupled to first retention post 81 and to retainer mover 84 and arranged to locate first retention post 81 normally in a pivot-blocking position extending toward base 20 and into first retention aperture 181. Axle means 831, 832 is coupled to lid 24 for supporting first retainer plate 183 for pivotable movement relative to lid 24 about a first retainer pivot axis 83P from an initial position to a pivoted position to move first retention post 81 away from the pivot-blocking position and base 20 to cause withdrawal of first retention post 81 from first retention aperture 181 formed in first blister card 14.

Lid 24 includes a top plate 50 arranged to overlie first blister card 14 located in the stored position when lid 24 is located in the closed position as suggested in FIG. 2. Top plate 50 of lid 24 is formed to include a controller-receiving aperture 280 opening into interior region 42 of case 12 when lid 24 is located in the closed position as suggested in FIG. 9.

Axle means 831, 832 includes a first axle 831 coupled to first retainer plate 183 and to top plate 50 and arranged to suspend first retainer plate 183 and retainer mover 84 in spaced-apart relation to top plate 50 of lid 24 to form a gap 380 therebetween when first retainer plate 183 is arranged to lie in the initial position as suggested in FIG. 9. Axle means 831, 832 further includes a second axle 832 coupled to first retainer plate 183 and to top plate 50 to locate first retainer plate 183 between the first and second axles 831, 832 and each of first and second axles 831, 832 is arranged to extend along first retainer pivot axis 83P as suggested in FIG. 9.

Retainer mover 84 is made of an elastic deformable material. In an illustrative embodiment, retainer mover 84 is formed to include corrugations arranged to lie in substantially spaced-apart parallel relation to first retainer pivot axis 83P as suggested in FIG. 9.

First retainer plate 183 includes a free end 183*f* coupled to first retention post 81 and a root end 183*r* coupled to retainer mover 84 as suggested in FIG. 9. Free end 183*f* is arranged to move away from base 20 and out of controller-receiving aperture 280 to move first retention post 81 away from the pivot-blocking position and out of first retention aperture 181 formed in first blister card 14 to free first blister card 14 to pivot about first card pivot axis 31P in response to movement of retainer mover 84 in controller-receiving aperture 280 into interior region 42 of case 12 toward first blister card 14 under an external force applied by a user and directed toward first blister card 14 while lid 24 is in the closed position and first blister card 14 is in the stored position as suggested in FIG. 11.

Retainer mover 84 is made of a deformable material such as a plastics material. Retainer mover 84 is configured to undergo a change in shape from an initial shape (shown, for example, in FIGS. 9 and 10) when first retainer plate 183 lies in the initial position to a deformed shape (shown, for example, in FIG. 11) during exposure to the external force applied by the user and movement of first retention post 81 out of first retention aperture 181 formed in first blister card 14. The deformable material included in retainer mover 84 is elastic to cause retainer mover 84 automatically to resume the initial shape (as suggested, for example, in FIG. 12) as soon as the external force is removed from retainer mover 84 to return first retention post 81 to the pivot-blocking position in interior region 42 of case 12. Retainer mover 84 is configured to provide means for applying a plate-pivoting torque to first retainer plate 183 to cause first retainer plate 183 to move from the pivoted position to the initial position in response to a shape change of retainer mover 84 from the initial shape to the deformed shape owing to elasticity of the deformable material comprising retainer mover 84 so that first retainer post 81 is moved to extend into first retention aperture 181 to assume the pivot-blocking position in response to movement of first blister card 14 from the exposed position relative to case 12 to the stored position in case 12.

First retainer plate 183 is arranged to lie in substantially coplanar relation to top plate 50 of lid 24 when first retainer plate 183 lies in the initial position as suggested in FIGS. 9 and 10. First retainer plate 183 is inclined to lie at an angle relative to top plate 50 upon movement of first retainer plate 183 to assume the pivoted position as suggested in FIG. 11.

First retention post 81 has a central axis 81*a* arranged to extend longitudinally therethrough and lie in substantially perpendicular relation to first retainer plate 183 as suggested in FIG. 9. Central axis 81*a* of first retention post 81 is arranged to lie in substantially spaced-apart parallel relation to first card pivot axis 31P when first retainer plate 183 lies in the initial position as suggested in FIG. 10 and in non-parallel relation to first card pivot axis 31P when first retainer plate 183 lies in the pivoted position as suggested in FIG. 11.

Case 12 further includes a second pivot post 32 coupled to base 20 and arranged to lie under lid 24 upon movement of lid 24 to the closed position and in spaced-apart relation to first pivot post 31 as suggested in FIG. 6. Package 10 also includes a second blister card 16 supported on second pivot post 32 for pivotable movement about a second card pivot axis 32P between a stored position inside interior region 42 of case 12 and an exposed position extending outside of the interior region 42 of case 12 as suggested in FIGS. 1-3.

Second blister card 16 is formed to include a first retention aperture 181 that is aligned to communicate with first retention aperture 181 formed in first blister card 14 when each of first and second blister cards 14, 16 is moved to assume the stored position in case 12 as suggested in FIG. 10. First card retainer 83 is arranged normally to extend into first retention apertures 181 formed in each of first and second blister cards 14, 16 while first and second blister cards 14, 16 lie in the stored position in the interior region of case 12 to block pivoting movement of the first blister card 14 about first card pivot axis 31P and to block pivoting movement of second blister card 16 about second card pivot axis 32P as suggested in FIG. 10.

First blister card 14 is formed to include a first pivot aperture 131 arranged to receive first pivot post 31 therein and to lie a first distance from first retention aperture 181 formed in first blister card 14 as suggested in FIG. 4. Second blister card 16 is formed to include a second pivot aperture 132 arranged to receive second pivot post 32 therein and lie a greater second distance from first retention aperture 181 formed in second blister card 16 as suggested in FIGS. 4 and 5.

Second blister card 16 is formed to include a first-post notch 231 sized to provide clearance to receive first pivot post 31 therein when second blister card 16 is moved to assume the stored position in case 12 as suggested in FIGS. 4-6. First blister card 14 is formed to include a second-post notch 232 sized to provide clearance to receive second pivot post 32 therein when first blister card 14 is moved to assume the stored position in case 112 as suggested in FIGS. 4-6

Each of first and second blister cards 14, 16 is formed to include a second retention aperture 182 as suggested in FIG. 4. Card-pivot controller 80 further includes a second card retainer 85 coupled to retainer mover 84 and arranged normally to extend into second retention apertures 182 formed in first and second blister cards 14, 16 while first and second blister cards 14, 16 lie in their stored positions to block pivoting movement of first blister card 16 about first card pivot axis 31P and pivoting movement of second blister card 16 about second card pivot axis 32P as suggested in FIGS. 9, 10, and 19. Second card retainer 85 includes a second retainer plate 185 and a second retainer post 82 having a central axis 82*a* as suggested in FIG. 9.

In an illustrative embodiment, retainer mover 84 and first and second card retainers 83, 85 cooperate to form a post carrier 83, 84, 85 that is coupled to each of first and second retention posts 81, 82. Post carrier 83, 84, 85 is shown, for example, in an initial positioning FIGS. 9 and 10 and in a card-releasing position in FIG. 11. Post carrier 83, 84, 85 includes a first pad 183, 831, 832 coupled to one end of retainer mover 84 and a second pad 185, 851, 852 coupled to another end of retainer mover 84 as suggested in FIG. 9.

Retainer mover 84 is arranged to lie between first and second card retainers 83, 85 and above a strip 14S included in first blister card 14 as suggested in FIGS. 4-6. Retainer mover 84 is arranged to extend between first and second retention apertures 181, 182 formed in first blister card 14 when first blister card 14 lies in the stored position in case 12. Retainer mover 84 is also configured to provide means for moving second card retainer 85 relative to lid 24 to withdraw second card retainer 85 from second retention aperture 182 formed in second blister card 16 to free second blister card 16 to pivot about second card pivot axis 32P and move toward the exposed position of second blister card 16 while lid 20 remains in the closed position as suggested in FIG. 11.

A cam ramp 87 is formed on a lower end of each of first and second retention posts 81, 82 as suggested in FIG. 4. Cam ramp 87 is arranged to face toward a perimeter edge 14*e* of first blister card 14 moving from the exposed position toward the stored position as suggested in FIG. 15. Perimeter edge 14*e* is configured to engage and ride on cam ramp 87 during movement of first blister card 14 from the exposed position toward the stored position to provide means for causing upward movement of first retention post 81 away from the pivot-blocking position and base 20 to allow continued movement of first blister card 14 to the stored position in interior region 42 of case 12 as suggested in FIGS. 14-19.

Package 10 comprises a one-piece case 12 and at least one non-child-resistant blister card. Two blister cards 14, 16 are disclosed in an illustrative embodiment.

Each blister card 14, 16 includes a shell made of a plastics material to hold medication such as a tablet 15. This medication is sealed in shell 17 using a separate laminate backing layer 19 to produce a non-child-resistant blister card that is relatively easy to open.

The overall shape of each blister card 14, 16 is designed in a particular configuration to fit into and function with case 12. Case 12 cooperates with blister cards 14, 16 and card-pivot controller 80 to provide resistance of access by a child and allows easy access by an adult.

Case 12 is molded in an opened position as shown in FIG. 4 with two halves 20, 24 connected by a hinge integral with both halves 20, 24. Each half 20, 24 features an opening (40, 60, respectively) on one side to access the blister card (16, 14, respectively), a recessed cavity (39, 59, respectively) for access to grasp the blister card, and various guide ribs 43, 44, 45, 46, 64, 65, 66. Each half 20, 24 has mold in a truss-like structure (38, 58, respectively).

Top half (lid) 24 features a latch 80 comprised of two flat panels 183, 185 connected by a flexible wavy panel 84. Two latch (retention) posts 81, 82 protrude toward the inside of case 12 from the flat panels. Guide ribs 44, 45 in bottom half 20 assist the release and return of the blister card.

In assembly, each blister card 14, 16 is inserted into case 12; one card 14 with medication facing up and another card 16 with medication facing down. Each card 14, 16 is mounted for pivotable movement on one of the pivot posts 31, 32 included in case 12. Case 12 is closed by folding the two halves 20, 24 at a living hinge 22. The two halves 20, 24 snap together permanently when fully closed.

Blister cards 14, 16 are enclosed by the two halves 20, 24. Blister cards 14, 16 are retained in case 12 in a child-resistant position by retention posts 81, 82 that extend normally through companion retention apertures 181, 182 formed in blister cards 14, 16.

In use, blister cards 14, 16 can be accessed by an adult by depressing the designated area of the flexible wavy panel 84 on card-pivot controller 80. Wavy panel 84 is attached to and located in between smooth panels 183, 185 included in card-pivot controller 80. Each panel 183, 185 acts as a lever with wavy panel 84 with connecting bridges 831, 832 and 851, 852 being the fulcrum points for companion panels 183, 185.

Depressing wavy panel 84 results in an outer end of each panel 183, 185 being lifted to raise companion retention posts 81, 82 out of companion retention apertures 181, 182 formed in blister cards 14, 16. With card-pivot controller 80 in the card-releasing position shown in FIG. 11, a user grasps one of blister cards 14, 16 and pulls it out of case 12. The recessed cavities 39, 59 formed in case 12 allows an area of each individual blister card 14, 16 to be grasped independently.

Since each blister card 14, 16 is also retained by a companion pivot post 31, 32, a blister card can only pivot outwardly about its pivot axis, when opened, until it reaches its fully extended pivoted position. Each pivot post 31, 32 passes through its companion blister card 14, 16 to prevent complete removal of blister cards 14, 16 from case 12. In the fully extended pivoted position, medication such as tablets 15 can be removed from the blister card. The other card can be accessed, using the same latch release, by the same illustrative method from the other side of case 12.

The blister card is returned to the child-resistant stored position in case 12 by rotating the card back to its original position. As the card moves back to the child-resistant stored position, it engages an angled edge 87 provided on each of the retention posts 81, 82 to face the returning card. The angle of edge (cam ramp) 87 allows the card to deflect and ramp over the retention post until the hole (retention aperture) 181, 192 in the card is aligned with the companion retention post 81, 82. In this position, the card springs back from its deflection assisted by special guide ribs 44, 45 on bottom half 20 so that retention posts 81, 82 extend into retention apertures 181, 182 formed in the cards 14, 16.

The invention claimed is:

1. A child-resistant package comprising a case including a base, a lid, a hinge coupled to the base and lid to support the lid for movement relative to the base from a closed position on the base to an opened position away from the base, and a first pivot post coupled to the base and lying under the lid upon movement of the lid to the closed position, a first blister card supported on the first pivot post for pivotable movement about a first card pivot axis between a stored position inside an interior region between the lid and the base upon movement of the lid to the closed position and an exposed position extending outside of the interior region while the lid remains in the closed position, the first blister card including a first retention aperture, and a card-pivot controller mounted on the lid for movement relative to the lid and to the first blister card, wherein the card-pivot controller includes a first card retainer arranged to extend into the first retention aperture in the first blister card while the first blister card lies in the stored position in the interior region of the case to block pivoting movement of the first blister card about the first card pivot axis toward the exposed position and a retainer mover coupled to the first card retainer for movement relative to the lid to move the first card retainer relative to the lid to withdraw the first card retainer from the first retention aperture formed in the first blister card to free the first blister card to pivot about the first card pivot axis and move toward the exposed position while the lid remains in the closed position, wherein the case further includes a second pivot post coupled to the base and arranged to lie under the lid upon movement of the lid to the closed position and in spaced-apart relation to the first pivot post, and further comprising a second blister card supported on the second pivot post for pivotable movement about a second card pivot axis between a stored position inside the interior region and an exposed position extending outside of the interior region, and wherein the second blister card includes a first retention aperture that is aligned to communicate with the first retention aperture in the first blister card when each of the first and second blister cards is moved to assume the stored position in the case and the first card retainer extends into the first retention apertures in each of the first and second blister cards while the first and second blister cards lie in the stored position in the interior region of the case to block pivoting movement of the first blister card about the first card pivot axis and to block pivoting movement of the second blister card about the second card pivot axis.

2. The package of claim 1, wherein the first card retainer includes a first retention post for moving into and out of the first retention aperture formed in the first blister card while the first blister card remains in the stored position and the first card retainer also includes a first retainer plate coupled to the first retention post and to the retainer mover and locating the first retention post normally in a pivot-blocking position extending toward the base and into the first retention aperture and axle means coupled to the lid supporting the first retainer plate for pivotable movement relative to the lid about a first retainer pivot axis from an initial position to a pivoted position to move the first retention post away from the pivot-blocking position and the base to cause withdrawal of the first retention post from the first retention aperture formed in the first blister card.

3. The package of claim 2, wherein the lid includes a top plate arranged to overlie the first blister card located in the stored position when the lid is located in the closed position, the top plate of the lid includes a controller-receiving aperture opening into the interior region of the case when the lid is located in the closed position, and the axle means includes a first axle coupled to the first retainer plate and to the top plate and suspends the first retainer plate and the retainer mover in spaced-apart relation to the top plate of the lid to form a gap therebetween when the first retainer plate lies in the initial position.

4. The package of claim 3, wherein the axle means further includes a second axle coupled to the first retainer plate and to the top plate to locate the first retainer plate between the first and second axles and each of the first and second axles extends along the first retainer pivot axis.

5. The package of claim 3, wherein the retainer mover is made of an elastic deformable material and includes corrugations arranged to lie in substantially spaced-apart parallel relation to the first retainer pivot axis.

6. The package of claim 3, wherein the first retainer plate includes a free end coupled to the first retention post and a root end coupled to the retainer mover and the free end moves away from the base and out of the controller-receiving aperture to move the first retention post away from the pivot-blocking position and out of the first retention aperture in the first blister card to free the first blister card to pivot about the first card pivot axis in response to movement of the retainer mover in the controller-receiving aperture into the interior region of the case toward the first blister card under an external force applied by a user and directed toward the first blister card while the lid is in the closed position and the first blister card is in the stored position.

7. The package of claim 6, wherein the retainer mover is made of a deformable material and undergoes a change in shape from an initial shape when the first retainer plate lies in the initial position to a deformed shape during exposure to the external force applied by the user and movement of the first retention post out of the first retention aperture in the first blister card and the deformable material is elastic to cause the retainer mover automatically to resume the initial shape as soon as the external force is removed from the retainer mover to return the first retention post to the pivot-blocking position in the interior region of the case.

8. The package of claim 2, wherein the lid includes a top plate, the first retainer plate lies in substantially coplanar relation to the top plate when the first retainer plate lies in the initial position, and the first retainer plate is inclined to lie at an angle relative to the top plate upon movement of the first retainer plate to assume the pivoted position.

9. The package of claim 8, wherein the first retention post has a central axis extending longitudinally therethrough and lying in substantially perpendicular relation to the first retainer plate and the central axis of the first retention post lies in substantially spaced-apart parallel relation to the first card pivot axis when the first retainer plate lies in the initial position and in non-parallel relation to the first card pivot axis when the first retainer plate lies in the pivoted position.

10. The package of claim 2, wherein a cam ramp is formed on a lower end of the first retention post and facing toward a perimeter edge of the first blister card moving from the exposed position toward the stored position and the perimeter edge engages and rides on the cam ramp during movement of the first blister card from the exposed position toward the stored position to provide means for causing upward movement of the first retention post away from the pivot-blocking position and the base to allow continued movement of the first blister card to the stored position in the interior region of the case.

11. The package of claim 10, wherein the retainer mover is made of a deformable material and undergoes a change in shape from an initial shape when the first retainer plate lies in the initial position to a deformed shape during exposure to the external force applied by the user and movement of the first retention post out of the first retention aperture in the first blister card and the deformable material is elastic to cause the retainer mover automatically to resume the initial shape as soon as the external force is removed from the retainer mover to return the first retention post to the pivot-blocking position in the interior region of the case, and wherein the retainer mover provides means for applying a plate-pivoting torque to the first retainer plate to cause the first retainer plate to move from the pivoted position to the initial position in response to a shape change of the retainer mover from the initial shape to the deformed shape owing to elasticity of the deformable material comprising the retainer mover so that the first retainer post is moved to extend into the first retention aperture to assume the pivot-blocking position in response to movement of the first blister card from the exposed position relative to the case to the stored position in the case.

12. The package of claim 1, wherein the first blister card includes a first pivot aperture arranged to receive the first pivot post therein and to lie a first distance from the first retention aperture in the first blister card, the second blister card includes a second pivot aperture arranged to receive the second pivot post therein and to lie a second distance from the first retention aperture in the second blister card, the second distance is greater than the first distance, the second blister card includes a first-post notch providing clearance to receive the first pivot post therein when the second blister card is moved to assume the stored position in the case, and the first blister card includes a second-post notch sized to provide clearance to receive the second pivot post therein when the first blister card is moved to assume the stored position in the case.

13. The package of claim 1, wherein the first card retainer includes a first retention post for moving into and out of the first retention aperture formed in the first blister card while the first blister card remains in the stored position and the first card retainer includes a first retainer plate coupled to the first retention post and to the retainer mover and locates the first retention post normally in a pivot-blocking position extending toward the base and into the first retention aperture and axle means coupled to the lid for supporting the first retainer plate for pivotable movement relative to the lid about a first retainer pivot axis from an initial position to a pivoted position to move the first retention post away from the pivot-blocking position and the base to cause withdrawal of the first retention post from the first retention aperture formed in the first blister card, wherein the retainer mover is made of a deformable material and undergoes a change in shape from an initial shape when the first retainer plate lies in the initial position to a deformed shape during exposure to the external force applied by the user and movement of the first retention post out of the first retention aperture in the first blister card and the deformable material is elastic to cause the retainer mover automatically to resume the initial shape as soon as the external force is removed from the retainer mover to return the first retention post to the pivot-blocking position in the interior region of the case, and wherein the retainer mover provides means for applying a plate-pivoting torque to the first retainer plate to cause the first retainer plate to move from the pivoted position to the initial position in response to a shape change of the retainer mover from the initial shape to the deformed shape owing to elasticity of the deformable material comprising the retainer mover so that the first retainer post is moved to extend into the first retention apertures formed in the first and second blister cards to assume the pivot-blocking position in response to movement of each of the first and second blister cards from the exposed position relative to the case to the stored position in the case.

14. The package of claim 1, wherein each of the first and second blister cards includes a second retention aperture and the card-pivot controller further includes a second card retainer coupled to the retainer mover and extending into the second retention apertures in the first and second blister cards while the first and second blister cards lie in their stored positions to block pivoting movement of the first blister card about the first card pivot axis and pivoting movement of the second blister card about the second card pivot axis.

15. The package of claim 14, wherein the retainer mover lies between the first and second card retainers and above a strip included in the first blister card and extends between the first and second retention apertures formed in the first blister card when the first blister card lies in the stored position in the case.

16. The package of claim 14, wherein the retainer mover is made of an elastic deformable material and includes corrugations and each corrugation extends along a line that is substantially orthogonal to a reference line intersecting each of the first and second card pivot axes when the lid lies in the closed position.

17. A child-resistant package comprising a case including a base, a lid, a hinge coupled to the base and lid to support the lid for movement relative to the base from a closed position on the base to an opened position away from the base, and a first pivot post coupled to the base and lying under the lid upon movement of the lid to the closed position., a first blister card supported on the first pivot post for pivotable movement about a first card pivot axis between a stored position inside an interior region between the lid and the base upon movement of the lid to the closed position and an exposed position extending outside of the interior region while the lid remains in the closed position, the first blister card including a first retention aperture, and a card-pivot controller mounted on the lid for movement relative to the lid and to the first blister card, wherein the card-pivot controller includes a first card retainer arranged to extend into the first retention aperture in the first blister card while the first blister card lies in the stored position in the interior region of the case to block pivoting movement of the first blister card about the first card pivot axis toward the exposed position and a retainer mover coupled to the first card retainer for movement relative to the lid to move the first card retainer relative to the lid to withdraw the first card retainer from the first retention aperture formed in the first blister card to free the first blister card to pivot about the first card pivot axis and move toward the exposed position while the lid remains in the closed position, wherein the case further includes a second pivot post coupled to the base and lying under the lid upon movement of the lid to the closed position and the card-pivot controller further includes a second card retainer coupled to the retainer mover to locate the retainer mover between the first and second card retainers and further comprising a second blister card supported on the second pivot post for pivotable movement about a second card pivot axis lying in substantially spaced-apart parallel relation to the first card pivot axis between a stored position inside the interior region formed in the case upon movement of the lid to the closed position and an exposed position extending outside of the interior region while the lid remains in the closed position, and wherein the second blister card includes a second retention aperture, the second card retainer extends into the second retention aperture formed in the second blister card while the second blister card lies in the stored position in the case to block pivoting movement of the second blister card about the second card pivot axis toward the exposed position of the second blister card, and the retainer mover provides means for moving the second card retainer relative to the lid to withdraw the second card retainer from the second retention aperture formed in the second blister card to free the second blister card to pivot about the second card pivot axis and move toward the exposed position of the second blister card while the lid remains in the closed position.

18. The package of claim 17, wherein the first blister card includes a second retention aperture that is aligned with the second retention aperture in the second blister card and receives a portion of the second card retainer therein when both of the first and second blister cards lie in their stored positions in the case and the lid lies in the closed position and the second blister card includes a first retention aperture that is aligned with the first retention aperture of the first blister card and receives a portion of the first card retainer therein when both of the first and second blister cards lie in the stored positions in the case and the lid lies in the closed position.

19. A child-resistant package comprising a case including an interior region, separate first and second pivot posts located in the interior region, a first side aperture opening into the interior region, and a second side aperture opening into the interior region, a first blister card supported on the first pivot post for pivotable movement about a first card pivot axis through the first side aperture between a stored position inside the interior region and an exposed position extending outside the interior region, a second blister card supported on the second pivot post for pivotable movement about a second card pivot axis through the second side aperture between a stored position inside the interior region and an exposed position extending outside the interior region, and a card-pivot controller mounted on the case for movement relative to the case and to each of the first and second blister cards, wherein the card-pivot controller includes a first retention post extending through first retention apertures formed in each of the first and second blister cards when the first and second blister cards lie in the stored positions to block pivotable movement of the first blister card about the first card pivot axis and of the second blister card about the second card pivot axis, a second retention post extending through second retention apertures in each of the first and second blister cards when the first and second blister cards lie in the stored positions to block pivotable movement of the first blister card about the first card pivot axis and the second blister card about the second card pivot axis, and a post carrier coupled to each of the first and second retention posts and mounted on the case for movement relative to the case between an initial position extending the first retention post into the first retention apertures in the first and second blister cards and the second retention post into the second retention apertures in the first and second blister cards and a card-releasing position withdrawing the first retention post from the first retention apertures in the first and second blister cards and the second retention post from the second retention apertures in the first and second blister cards to free the first blister card to pivot about the first card pivot axis to move through the first side aperture and to free the second blister card to pivot about the second card pivot axis to move through the second side aperture.

20. The package of claim 19, wherein the post carrier includes a first pad pivotably coupled to the case for pivotable movement about a first retainer pivot axis and coupled to the first retention post, a second pad pivotably coupled to the case for pivotable movement about a second retainer axis and coupled to the second retention post, and a retainer mover coupled to each of the first and second pads to move relative to the case to cause pivoting movement of each of the first and second pads relative to the case to cause movement of the first retention apertures and for movement of the second retention post into and out of the second retention apertures.

21. The package of claim 20, wherein the first pad includes a first retainer plate coupled to the first retention post and to the retainer mover and first axle means coupled to the lid for supporting the first retainer plate for pivotable movement relative to the lid about a first retainer pivot axis in a clockwise direction from an initial position to a pivoted position to withdraw the first retention post from the first retention apertures in the first and second blister cards in response to movement of the retainer mover toward the first and second blister cards under an external force applied by a user and directed toward the first and second blister cards while the first and second blister cards are in the stored positions in the case.

22. The package of claim 21, wherein the retainer mover is made of an elastic deformable material and includes corrugations lying in substantially spaced-apart parallel relation to the first retainer pivot axis.

23. The package of claim 21, wherein the second pad includes a second retainer plate coupled to the second retention post and to the retainer mover and second axle means coupled to the lid for supporting the second retainer plate for pivotable movement relative to the lid about a second retainer pivot axis in a counterclockwise direction from an initial position to a pivoted position to withdraw the second retention post from the second retention apertures in the first and second blister cards in response to movement of the retainer mover toward the first and second blister cards under an external force applied by a user and directed toward the first and second blister cards while the first and second blister cards are in the stored positions in the case.

24. The package of claim 23, wherein the post carrier is made of an elastic deformable material and the retainer mover includes corrugations lying in substantially spaced-apart parallel relation to the first and second retainer pivot axes.

25. The package of claim 19, wherein the case and the card-pivot controller are made of a plastics material and cooperate to form a monolithic element.

* * * * *